United States Patent [19]

Folk

[11] 4,413,859

[45] Nov. 8, 1983

[54] MINING OF SULPHUR WITH FOAM BARRIER

[75] Inventor: Stewart H. Folk, Houston, Tex.

[73] Assignee: Stewart Folk & Company, Incorporated, Houston, Tex.

[21] Appl. No.: 289,783

[22] Filed: Aug. 3, 1981

[51] Int. Cl.[3] ..... E21C 41/14

[52] U.S. Cl. ..... 299/4; 299/6

[58] Field of Search ..... 299/4, 6; 166/272, 303

[56] References Cited

U.S. PATENT DOCUMENTS

| | | | |
|---|---|---|---|
| 870,620 | 11/1907 | Frasch | 299/6 |
| 1,750,136 | 3/1930 | Schroeder | 299/6 |
| 2,784,954 | 3/1957 | Ilfrey | 299/6 |
| 3,410,344 | 11/1968 | Cornelius | 166/303 |
| 3,623,770 | 11/1971 | Ayres et al. | 299/6 |

*Primary Examiner*—Ernest R. Purser

[57] ABSTRACT

A method for mining subsurface deposits by injection of foam or a foaming agent plus air or other gas, or foam-making materials, into a selected porous zone above a sulphur bed or zone, and concomitantly displacing the gas and/or fluids occupying such porous zones concomitantly and/or thereafter, heating the sulphur bed below the foam injected deposit with superheated water or other means with the foam confining the upward movement of the superheated water or other fusion medium to the sulphur-bearing zone.

6 Claims, 2 Drawing Figures

MINING OF SULPHUR WITH FOAM BARRIER

FIELD OF THE INVENTION

The present invention relates to subsurface mining of elemental sulphur by the Frasch or other bore hole methods. More particularly, in the method of the present invention, while the underground sulphur deposit is liquefied through raising its temperature above the melting point—either by introduction of a hot fluid or hot gas into the sulphur deposit, or by other means of heating the sulphur—and the sulphur is brought to the surface in molten or liquid form, the heating medium is confined to the sulphur deposit by an overlying layer of foam in a porous zone or zones above the sulphur deposit.

BACKGROUND OF THE INVENTION

Deposits of elemental sulphur have been found in the caprock (consisting mainly of limestone, gypsum, and anhydrite) of a number of salt domes in areas bordering and underlying the Gulf of Mexico; in carbonate and sulphate strata consisting largely of limestone, gypsum, and anhydrite in West Texas and various other regions (notably Iraq, Mexico, and Poland); and in other types of rocks such as diatomites, volcanic tuffs, etc., in other areas.

The elemental sulphur found in the ground was originally deposited in fractures, solution cavities, and/or other types of cavities or void spaces in the caprock, carbonate and sulphate strata, and other types of host rocks. In most cases, a cavity which contains sulphur also has considerable void space. The rocks or formations enveloping or dispersed through the a sulphur deposit also have considerable porosity, commonly ten percent or more. The pores or voids in the rocks can range from pin-hole size to caverns ten feet or more in height. In practically all subsurface sulphur deposits, the rock pores and cavities are occupied or filled by gas, oil, and/or water.

Most of the underground sulphur deposits and their rock environment are overlain by beds of clay/shale or other sediments that contain little or no elemental sulphur. Thickness of such overlying beds usually can be measured in hundreds of feet. Some underground sulphur deposits overlain by appreciable thicknesses of overburden can be mined by conventional underground mining methods. At the present time, however, practically all mining of subsurface sulphur deposits is accomplished by the Frasch or hot water method. Sulphur deposits mined by the Frasch or hot water method include all known deposits of commercial importance in the caprock of salt domes in the U.S.A.; and a number of deposits in carbonate and sulphate strata in West Texas, Mexico, Iraq, and Poland.

The Frasch or hot water method of mining sulphur typically involves the following procedures:

(1) a number of wells, usually located about 100 feet apart, are drilled to the underground sulphur-bearing zones, generally by means of rotary drilling rigs but occasionally with percussion type drilling equipment. Each sulphur production well generally has four concentric pipes or tubular members as follows: (a) a protective tubular casing string extending from the surface to the top of the caprock or sulphur-bearing zone; (b) a tubular pipe string about 6 inches in diameter, with perforations in the lowermost section, extending from the earth's surface to near the bottom of the sulphur-bearing zone; (c) a tubular pipe string about 3 inches in diameter that extends from the earth's surface to a short distance above the bottom of the 6" pipe; and (d) a tubular pipe string about one inch in diameter extending from the earth's surface to a depth somewhat greater than half the depth to the bottom of the 6" pipe string. Other pipe sizes may be used; but this in no way changes the general theory of Frasch mining;

(2) water heated under pressure, to about 325° F., is pumped down the annular spaces between the six-inch and three-inch pipes, and between the three-inch and one-inch pipes during an initial heating period commonly ranging between 24 hours and 96 hours. The superheated water flows out the holes at the bottom of the six-inch pipe into the sulphur-bearing zone and moves upwardly inasmuch as the superheated water has a lower specific gravity than the relatively cool water occupying the voids in the sulphur-bearing zone. The temperature of the sulphur-bearing zone increases, and when it exceeds the melting point of sulphur (about 240° to 245° F.) the sulphur liquifies. Being about twice as heavy as water, the molten or liquid sulphur then flows to the bottom of the well;

(3) at the end of the initial heating period, pumping of superheated water down the three-inch pipe is discontinued. The static pressure of fluid within the sulphur-bearing zone will force the molten sulphur several hundred feet up the three-inch pipe. Then compressed air is then pumped down the one-inch pipe to aerate the molten sulphur and lighten it so that the aerated sulphur will rise to the surface and flow into collecting vessels.

Each production well recovers sulphur from only a small area, usually less than 0.5 acre in extent; and the average producing life of a single well is only 3–4 months. Consequently new wells must be drilled continually as long as a deposit is mined by the Frasch method.

In the Frasch process, provision generally must be made for removing water as well as sulphur from the sulphur deposit and the contiguous porous zones in order to relieve the subsurface fluid pressure that otherwise would become excessive during the course of Frasch mining. The fluid pressure within the sulphur deposit and contiguous porous zones usually increases during Frasch mining because the volume of superheated water that is injected for mining purposes exceeds the volume of sulphur extracted; and the low-permeability strata above and below the sulphur deposit and the contiguous porous zones prevents or restricts the escape of fluids from those zones. Pressure relief is accomplished by drilling "bleed wells", usually located near the periphery of the sulphur deposit, and at structurally low positions, to remove relatively cool water from the base part of the sulphur deposit or underlying porous zone.

The pores and cavities in the sulphur-bearing zone contain fluid which is cooler and has higher specific gravity than the injected superheated water. Consequently, the injected superheated water rises by convection after it exits from the six-inch pipe near the bottom of the well and contacts the cooler water. Although the superheated water cools somewhat as it gives up its heat to the melting sulphur and host rocks and fluids, it is still very hot when it enters porous barren zones overlying and/or contiguous with the sulphur-bearing zone. In fact, temperatures in the range of 220° F. to 290° F. can be found in porous barren zones overlying the sulphur deposit zones from which sulphur is being mined or has been mined by the fusion method; whereas prior to the fusion mining operations the temperatures of porous barren zones usually were less than 100° F.

The thickness of the porous barren zones overlying the sulphur-bearing zones in various deposits mined by a fusion method ranges to several hundred feet. In some cases, the porous barren zones include beds of sand or gravel with great lateral extent. Thus, enormous volumes of hot water, representing vast amounts of wasted energy, are lost to the porous barren zones overlying and/or contiguous with the sulphur-bearing zones mined by the fusion method. In many Frasch mines, 80% or more of the heat energy consumed is lost through escape of hot water to porous barren zones overlying and/or contiguous with the sulphur-bearing zone.

Heretofore, various means of preventing or restricting the escape of hot water from the sulphur-bearing zone have been used or proposed. Such means and related patents are listed below:

(1) injection of sawdust or other comminuted material into the barren zone (U.S. Pat. No. 870,620);

(2) injection of air or other gas to displace water from upper part of caprock (U.S. Pat. Nos. 1,401,593; 1,750,136; and 2,896,932);

(3) introduction of sand into well bore and caprock, from overlying strata (U.S. Pat. No. 1,573,026);

(4) injection of mud and into caprock (U.S. Pat. No. 1,628,873);

(5) replacing the water naturally in the sulphur deposit with brine or other liquid of comparatively heavy specific gravity (U.S. Pat. No. 1,648,210);

(6) emplacement of an impervious barrier (aerated cement) between sulphur-bearing zone and overlying porous barren zone (U.S. Pat. No. 2,784,954);

(7) introducing a silicate solution into a porous zone adjacent to a sulphur-bearing zone, and allowing the solution to set into a relative firm and impermeable mass (U.S. Pat. No. 3,623,700).

BRIEF SUMMARY OF THE INVENTION

The present invention provides a method and apparatus for increasing the efficiency of mining sulphur using the Frasch or hot water process by preventing or reducing the escape or upward migration of superheated water from the sulphur-bearing zone, and thereby minimizing the volume of superheated water and amount of energy required for recovering each ton of sulphur. The method and apparatus of this invention permit large savings in fuel and water requirements in the mining of subsurface sulphur deposits as compared to the conventional Frasch process heretofore employed extensively in the sulphur industry. The present invention provides for significantly reduced sulphur mining costs, and can permit the continued operation of heretofore marginal wells, mining areas, and mines; and also permit the resumption of mining subsurface sulphur deposits previously mined but abandoned some time ago because they were uneconomic; and thus permit greater recovery of sulphur resources.

The present invention involves injecting foam (a dispersion of gas in a solution such that the liquid is the continuous phase and the gas is the discontinuous phase) through one or more bore holes or wells into a porous barren zone (containing little or no elemental sulphur) that overlies and/or is contiguous with a subsurface sulphur-bearing zone, and thereby displacing the gases and/or liquids that previously occupied the pore spaces and cavities in said porous barren zone. In some instances, air/gas and a foaming agent which will generate foam upon mixing with liquids in the subsurface zone may be injected. Egress for the displaced gases and/or liquids can be provided by one or more bore holes or wells with pipe or casing extending from the surface to or near the bottom of the barren porous zone, or—if subsurface conditions so dictate—to some point in the contiguous sulphur-bearing zone. To facilitate the replacement of said gases and/or liquids with foam, the "bleed" wells for egress of the displaced gases/liquids may be equipped with suitable pumps, air-lift, or other devices commonly used for bringing subsurface fluids to the surface.

With foam occupying part or all of the cavities and pore spaces in the barren zone overlying and/or contiguous with the sulphur-bearing zone, the hot water or other medium used for melting the sulphur will not rise by convection into the barren porous zone. Thus the heat energy supplied for melting sulphur may be confined largely or entirely to the sulphur-bearing zone without appreciable loss of heat to a zone where the heat serves no useful purpose.

Other benefits derived from the present invention are that fewer production wells will be required in that greater sulphur recovery will be attained in a given area. In sulphur mining by the fusion method, the area depleted by each well generally is less than 0.5 acre, and even so residual spines of sulphur between production wells are not recovered. But in using the method of the present invention, with foam preventing loss of the heating medium into porous barren zones, the heating medium will migrate greater distances laterally from the production well; and consequently the production wells may be more widely spaced; and more of the sulphur in the deposit will be liquified, and will drain into the production wells.

The above mentioned porous barren zones may be either (a) zones that contained little or no sulphur prior to mining operations; or (b) zones that previously contained considerable elemental sulphur, but from which sulphur has been extracted by the fusion or other method.

The present invention may be used in mining sulphur deposits that were not previously mined; and/or in mining sulphur deposits already being exploited; and/or in mining sulphur deposits that had been only partially depleted in previous periods, but mining was suspended or terminated for economic or other reasons at some time in the past.

IN THE DRAWINGS

DESCRIPTION OF THE PREFERRED EMBODIMENT

Figure 1:
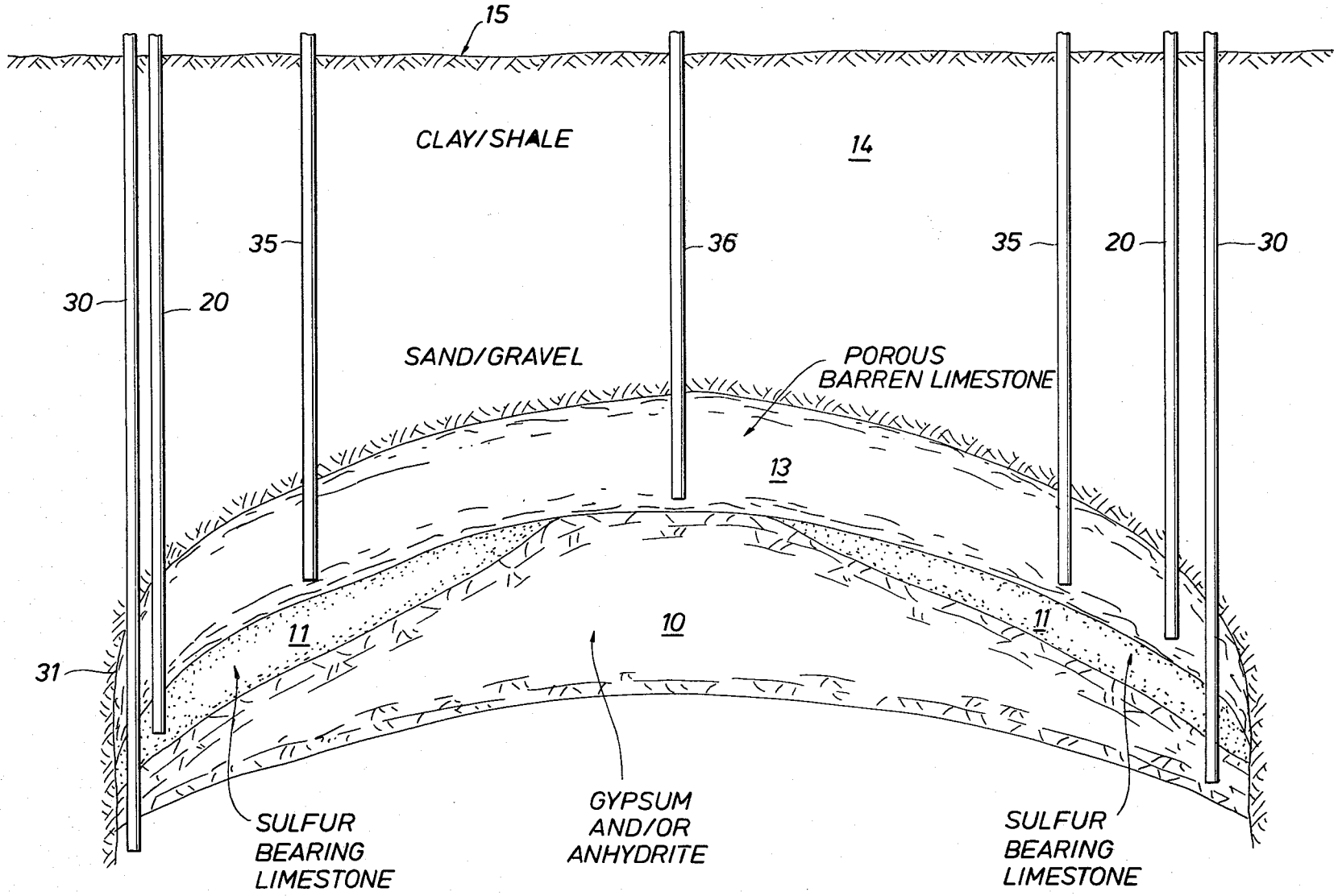
FIG. 1 illustrates a cross section of earth formations in which the present invention is embodied.

Referring now to FIG. 1, the cross section of earth formations is illustrated with various strata, including a lowermost gypsum or anhydrite zone 10. Above the gypsum/anhydrite zone 10 are sulphur-bearing limestone deposits 11, 12 which commonly extend in an inclined relationship with respect to the horizontal. Above the limestone and gypsum/anhydrite zones is a porous, barren limestone 13 which contains water, oil or gas. Above the limestone zone is 14 which extends upwardly to the earth's surface 15. The zone 14, between the barren limestone 13 and the surface 15 of the earth, may contain any number of different types of strata such as shale, sand, gravel, and limestone. The strata are not illustrated as they are not relevant to the present invention.

As illustrated in FIG. 1, a cased wall 20 traverses the earth formations and extends down into the sulphur-bearing limestone 11 from which sulphur is produced.

Figure 2:
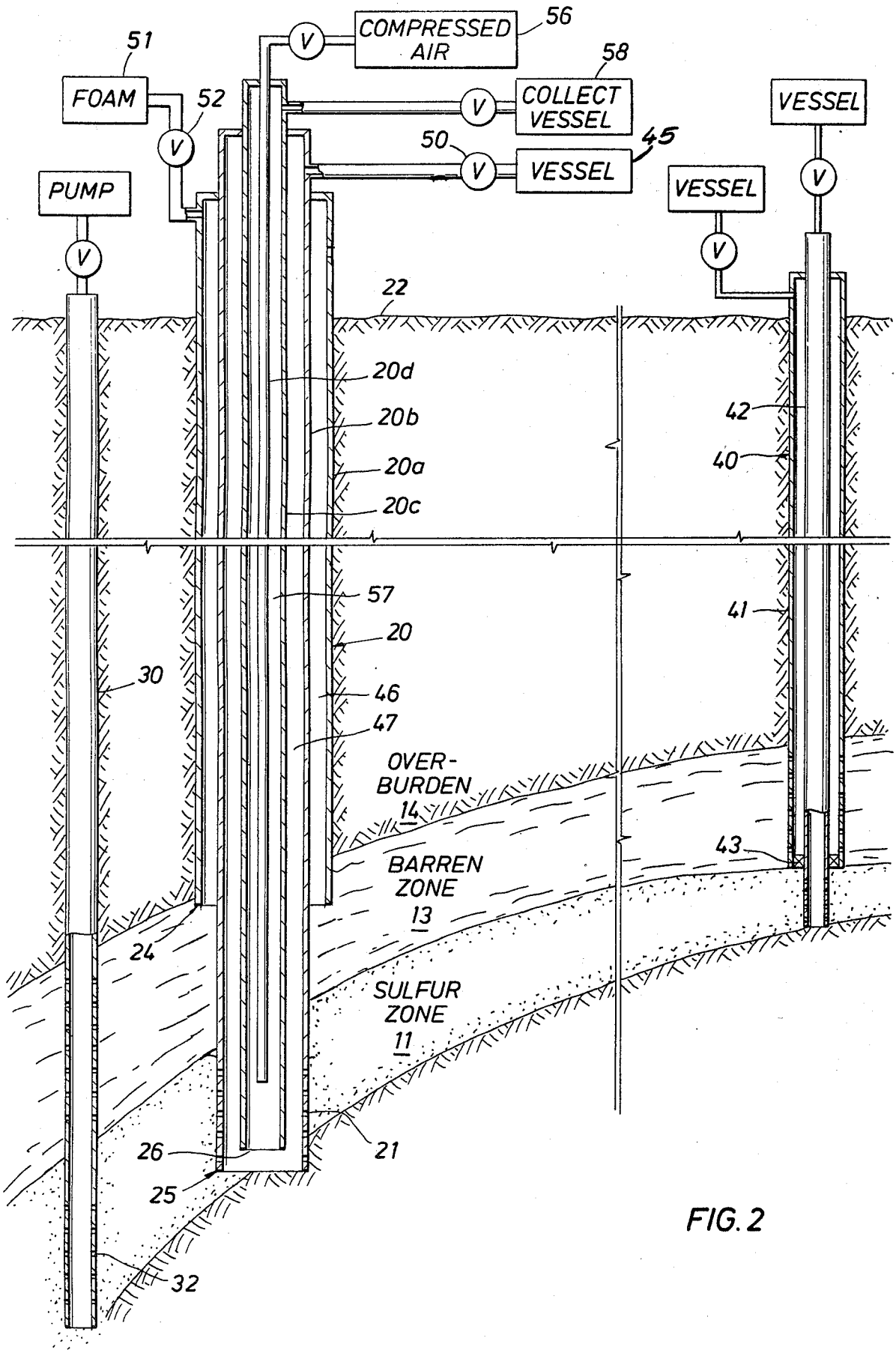
FIG. 2 illustrates a cross section of bore holes traversing earth formations and the pipe arrangement for producing sulphur.

As illustrated in FIG. 2, the cased well 20 includes a protective tubular casing **20*a* which extends from the surface 22 of the earth to the top 24 of the barren limestone zone 13. If desired, the casing 20*a* can be extended through the zone 13 and perforated. The casing 20, in some cases, may be cemented in place in the bore hole by an annulus of cement (not shown). An inner pipe 20*b*, about six inches in diameter with perforations 21 in the lowermost section, extends into or through the sulphur zone 11 and is concentrically received in the casing 20*a*. The pipe 20*b* extends from the earth's surface 22 to some point 25 within or below the sulphur-bearing zone 11. A smaller pipe 20*c* is concentrically received in the pipe 20*b* and extends from the earth's surface 22 to a location 26 which is a short distance above the bottom 25 of the larger pipe 20*b*. A concentrically arranged center pipe 20*d*, which has a smaller diameter, extends from the earth's surface 22 to a location about half of the vertical depth of the sulphur-bearing bed or zone 11**.

In addition to the sulphur production well 20, a number of bleed wells 30 and foam injection wells 35, 36 are provided. The bleed wells 30 are located near the lowermost section of the strata so as to remove the relatively cold or cooler water from the strata. The foam injection wells 35, 36 are located at suitably spaced intervals to facilitate the dispersion of the foam through the barren porous strata.

As shown in FIG. 1, the wells 20, 35 and 36 are used to inject foam or foaming agents under pressure to create a dispersion throughout the barren porous strata 13 which overlies and are contiguous to the sulphur zones 11 and 12. The foam may be heated, if desired, to further contain the energy in the superheated water. Next, the wells 20 are used to inject superheated water for a period of time sufficient to melt the sulphur. The melted sulphur flows to the well 20 where it is recovered by aeration. The superheated water, which loses its heat energy, is recovered from the bleed wells 30 and if desired, reheated and recycled to the superheated water sources for injection into the wells 20.

As shown in FIG. 2, a former sulphur production well 40 can be used as a common well for injecting foam or foaming agents into the depleted sulphur zone 11 and/or the barren zone 13. If desired, the well may have two or more concentric pipes 41, 42, in which case the the pipe 42 is sealed off by conventional packer 43 near the lower end of the pipe 41 and both pipes 41 and 42 are perforated in the interval extending through the zones 11 and 13.

In the operation of the present invention, after the wells are drilled and the pipes or casings installed, a suitable foam or foaming agent plus air is pumped down the pipe annulus **20*a* from a foam generator or pump 51 at the earth's surface. A valve 52 controls the flow of injected materials. The foam and foaming agents contemplated by the present invention are readily available; for example, some are presently used as a drilling fluid and also in secondary and tertiary oil recovery operations. Foam is injected also through the wells 35 or 36**.

The term "foam" is characterized as a dispersion of gas in liquid so that the gas is the discontinuous phase and the liquid is the continuous phase. The foam is prepared by adding a "foaming agent" to the liquid and then intermix the two phases by inputting air or other mechanical means. Foaming agents are surface active materials readily available from various chemical companies. Certain waste products from paper mills are also used as foaming agents. Foam typically has a low density and behaves like a pseudoplastic fluid.

As shown in FIG. 2, the foam pumped down the pipe **20*a* and into the porous barren zone 13. The wells 35 and 36 are single pipe wells, but multiple pipe wells can be used for injection also. For example, the pipe 41** can be used to inject foam into the barren strata.

With the foam in place in the subsurface strata, superheated water, i.e., water heated under pressure in a heater or vessel 45 to a temperature of about 325° F. is pumped down the annular space 47 defined by the pipes **20*b* and 20*c*. Flow valve 50 at the earth's surface controls the admission of the superheated water to the annular space 47. In the lower end of the annular space 47 is a seal 48 which is located approximately mid-way of the perforations 21. Thus, the superheated water flows out of the perforations 21 above the seal 48 and into the sulphur-bearing zone 11. The heat of the superheated water flows upwardly and sulphur will melt. Being heavier than water, sulphur flows to the bottom of the casing 20*b* and through the perforations below the seal 48 and into the pipe 20*c*. The foam in the barren zone 13 serves as a terminal barrier so that the heat energy is retained in the sulphur zone 11. Compressed air from an air source 56 at the earth's surface is pumped down the center pipe 20*d* so that sulphur is recovered through the annulus 57 to a surface collection vessel 58. In the operation of the present invention, foam is independently supplied to the barren zone 13 so that it can be injected continuously or intermittently. Cooled water is recovered by the bleed well 30 and can be reheated to be re-injected through the source 45** of superheated water.

While I have described the hot water Frasch method, it will be clear that other techniques of air heating or electrical current heating can be used with the present invention.

It should be realized that the foregoing description is merely illustrative of the present invention and that the invention is defined in the claims which follow.

I claim:

1. The method of mining sulphur from subterranean formations containing sulphur-bearing zones below an adjacent porous zone comprising the steps of:

developing, in the adjacent porous barren zone, a layer of pseudoplastic foam dispersion throughout the zone overlying the sulphur-bearing zones;

heating the sulphur-bearing zone below the form dispersion independently of the introduction of the foam dispersion;

maintaining the heating in the sulphur-bearing zone a sufficient time to convert the elemental sulphur to a liquid; and removing the liquid sulphur from the sulphur-bearing zone to the earth's surface while maintaining the layer of foam dispersion above the sulphur-bearing zone.

2. The method as defined in claim 1 wherein said foam dispersion is injected at spaced apart horizontal locations in the porous barren zone for achieving a layer of foam over the sulphur-bearing zones.

3. The method as defined in claim 2 wherein the foam dispersion is injected under pressure to flow from the spaced apart locations forward to other locations.

4. The method as defined in claim 3 wherein the heating is accomplished by introducing superheated water to transmit heat energy to the sulphur-bearing zone for a sufficient period of time to liquify the sulphur.

5. The method as defined in claim 4 wherein the foam dispersion is low density and fine textured.

6. The method as defined in claim 4 wherein the foam dispersion is created by introducing foaming agents into the porous barren zone.

* * * * *